US006390327B1

(12) United States Patent
Cornell

(10) Patent No.: US 6,390,327 B1
(45) Date of Patent: May 21, 2002

(54) MEDICINE CONTAINER WITH ALARM

(76) Inventor: Bradley Allen Cornell, 140 NW. Hills Dr., Kerrville, TX (US) 78028

( * ) Notice: Subject to any disclaimer, the term of this patent is extended or adjusted under 35 U.S.C. 154(b) by 0 days.

(21) Appl. No.: 09/469,846

(22) Filed: Dec. 21, 1999

(51) Int. Cl.[7] ..... G07F 11/00
(52) U.S. Cl. ..... 221/3; 206/534
(58) Field of Search ..... 221/2, 3, 7, 13, 221/9, 25, 26, 5, 86, 89, 76; 206/531, 534, 532, 534.1

(56) References Cited

U.S. PATENT DOCUMENTS 3,651,927 A * 3/1972 Richardson et al. ..... 206/534
4,706,815 A * 11/1987 Curtis et al. ..... 206/531
5,020,037 A * 5/1991 Raven ..... 221/2
5,775,536 A * 7/1998 Lambelet, Jr. et al. ..... 221/5

* cited by examiner

*Primary Examiner*—Kenneth W. Noland
(74) *Attorney, Agent, or Firm*—John R Casperson

(57) ABSTRACT

A clamshell case for birth control pills is provided with a 24 hour alarm device to remind the user to take the pills at the same time each day.

8 Claims, 1 Drawing Sheet

MEDICINE CONTAINER WITH ALARM

BACKGROUND OF THE INVENTION

In one aspect, this invention relates to a container for medicines. In another aspect, this invention relates to a container which is especially well suited for containing birth control pills.

Birth control pills are typically supplied on a foil backed punch-through sheet. Usually, 28 pills are supplied on each sheet, and some means is provided for labeling the pills by day of week. Providing the pills in this manner makes it easier for the user to ascertain whether the daily dose has been taken.

The effectiveness of the pills to prevent pregnancy however, declines when the pills are not taken at the same time each day. Under ideal conditions, with the pill being taken at the same time each day, the pills are 99.9 percent effective, on an annual basis. In other words, the pregnancy rate is 0.1 percent per year. When the pill is taken each day, but not at the same time., the pregnancy rate increases in the range of 30 to 80 times. In order words, the pregnancy rate is in the range of 3 to 8 percent per year. Obviously, some women are more likely to forget to properly take the pill than other, but, over a time span of, say, 30 years, the chances of at least one unintended pregnancy are undesirably high for most everyone.

Means for rendering it more likely that birth control pills will be taken at the same time every day would be very desirable.

SUMMARY OF THE INVENTION

In one embodiment of the invention, a medicine container is provided with an alarm device. The medicine container is preferably of a clamshell configuration. The apparatus comprises a first half of a clamshell case, and a second half of a clamshell case. The first half of the clamshell case has a concave inner surface with means for locating a pill-carrying card. The second half of the clamshell case carries an electronic alarm device.

Although the invention could be employed for a wide range of medicaments, it is especially well suited for birth control pills. By utilizing an electronic alarm device which emits an audible signal precisely every 24 hours, a woman can be reminded to take her daily birth control pill at precisely the most effective time.

DETAILED DESCRIPTION OF THE INVENTION

Figure 3:
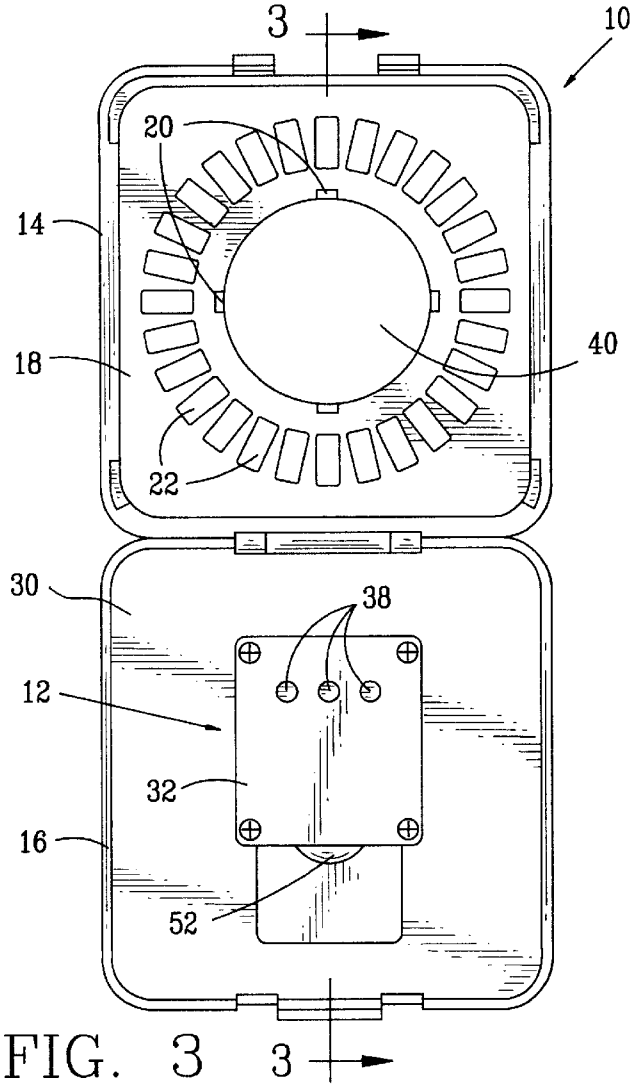
FIG. 3 is a cross sectional view of the case of FIG. 2 when viewed along lines 3—3.
Figure 2:
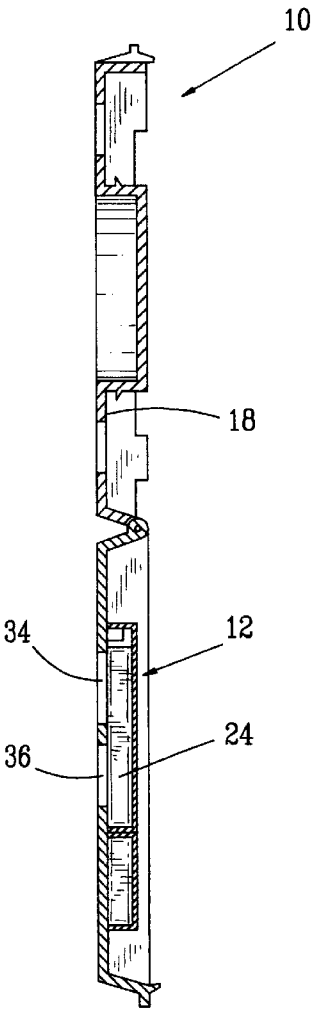
FIG. 2 is a pictorial representation of an opened clamshell case according to an embodiment of the invention showing the inside surfaces.
Figure 1:
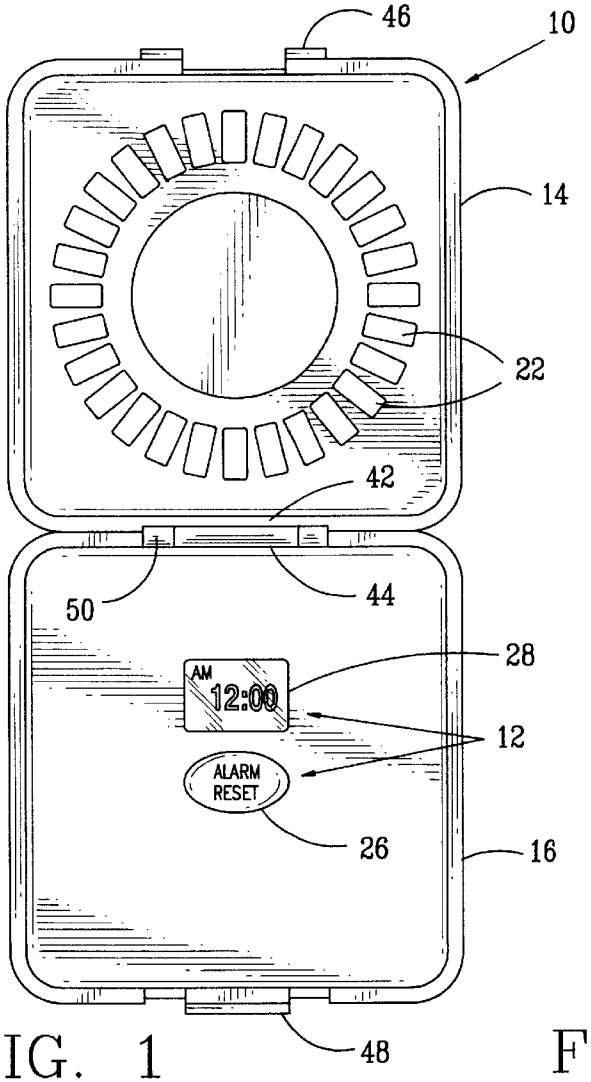
FIG. 1 is a pictorial representation of an opened clamshell case according to an embodiment of the invention showing the outside surfaces.

In one embodiment of the invention, a medicine container 10 is provided with an electronic alarm device 12. The medicine container is preferably of a clamshell configuration. The apparatus comprises a first half 14 of a clamshell case, and a second half 16 of a clamshell case. The first half of the clamshell case has a concave inner surface 18 with means 20 for locating a pill-carrying card. The second half of the clamshell case carries the electronic alarm device 12.

The first half of the clamshell case further defines an array of apertures 22 positioned with respect to the locating means so that pills carried by the pill carrying card can be pressed through the apertures from the inside to the outside of the clamshell case.

The electronic alarm device 12 carried by the second half of the clamshell case comprises an audio alarm means, a reset button 26 for turning off the audio alarm means and resetting the audio alarm to turn on at a subsequent time, a timer, and a visual time display means 28 to display the output from the timer. The alarm means is preferably designed so that the reset button turns off the audio alarm and automatically resets the alarm to go off 24 hours later. If desired, the alarm can go off with an alarm signal, followed by periodic reminder signals until the reset button is pressed.

In one embodiment of the invention, a second half 16 of the clamshell case has a concave inner surface 30, and the electronic alarm device comprises an electronics case 32 mounted to the concave inner surface of the second half of the case. The second half of the case further has a first aperture 34 for locating the visual time display means and a second aperture 36 for locating the reset button. An LCD device makes a highly suitable visual time display means. A plurality of control buttons 38 for controlling the timing device are preferably provided which accessible from the inside of the case.

For carrying birth control pills, it is advantageous for the apertures 22 through the first half of the case to arranged in a circular array. A date wheel 40 can be rotatably carried by the first half of the case to permit a weekday to be associated with each pill of the array. The first half of the case can define 28 apertures.

Each of the first half of the case and the second half of the case will generally have reciprocal hinge halves 42 and 44 along one edge which are joined to each other, thereby hinging the two halves of the case together. A pin, such as a spring-biased watch band pin, can join the halves. Reciprocal clasp halves 46 and 48 along an edge opposite from the hinge halves can also be provided which engage by snapping together into a locking position, thereby providing a mechanism for closing the case. In a further preferred embodiment, a spring 50 can be operatively associated with the hinge halves to open the case a small amount when the clasp halves are disengaged.

The case halves can be conveniently formed from injection molded thermoplastic. In use, a card carrying an array of pills can be located in the first half of the case, and a battery 52 is carried by the electronic alarm device. The card generally comprises a paper layer sandwiched between a thermoplastic layer and a foil layer. The paper layer has apertures which locate the pills and the thermoplastic layer has bubbles which can be pressed to force the pills though the foil and through the apertures through the first half of the case.

While certain preferred embodiments of the invention have been described herein, the invention is not to be construed as being so limited, except to the extent that such limitations are found in the claims.

What is claimed is:

1. Apparatus comprising a first half of a clamshell case, and a second half of a clamshell case, wherein the first half of the clamshell case has a concave inner surface with means for locating a pill-carrying card, and wherein the second half of the clamshell case carries an electronic alarm device, wherein the first half of the clamshell case further defines an array of apertures positioned with respect to the locating means so that pills carried by the pill carrying card can be pressed through the apertures from the inside to the outside of the clamshell case, and wherein the electronic alarm device carried by the second half of the clamshell case comprises an audio alarm means, a reset button for turning off the audio alarm means and resetting the audio alarm to turn on at a subsequent time, a timer, and a visual time display means to display the output from the timer.

2. Apparatus as in claim 1 wherein the reset button turns off the audio alarm and automatically resets the alarm to go off 24 hours later.

3. Apparatus as in claim 2 wherein a second half of the clamshell case has a concave inner surface, and the electronic alarm device comprises an electronics case mounted to the concave inner surface of the second half of the case, wherein the second half of the case further has a first aperture for locating the visual time display means and a second aperture for locating the reset button.

4. Apparatus as in claim 3 wherein the electronic alarm device further comprises a plurality of control buttons accessible from the inside of the case and the visual time display means comprises an LCD device.

5. Apparatus as in claim 4 wherein the apertures through the first half of the case are arranged in a circular array.

6. Apparatus as in claim 5 wherein first half of the case defines 28 apertures.

7. Apparatus as in claim 5 wherein each of the first half of the case and the second half of the case have reciprocal hinge halves along one edge which are joined to each other, thereby hinging the two halves of the case together, reciprocal clasp halves along an edge opposite from the hinge halves which engage by snapping together into a locking position, thereby closing the case.

8. Apparatus as in claim 7 further comprising a spring operatively associated with the hinge halves to open the case a small amount when the clasp halves are disengaged.

* * * * *